United States Patent [19]

Helderle et al.

[11] Patent Number: 4,726,422

[45] Date of Patent: Feb. 23, 1988

[54] ANNULAR SAFETY ASSEMBLY FOR AN OIL WELL, ESPECIALLY A DOUBLE PRODUCTION ZONE WELL

[75] Inventors: Paul M. Helderle, Champdeuil; Jean A. Lescoeur, Paris, both of France

[73] Assignee: Total Compagnie Francaise des Petroles, Paris, France

[21] Appl. No.: 823,444

[22] Filed: Jan. 27, 1986

[30] Foreign Application Priority Data

Feb. 5, 1985 [FR] France ..... 85 01552

[51] Int. Cl.[4] ..... E21B 33/128; E21B 34/06

[52] U.S. Cl. ..... 166/133; 166/122; 166/189

[58] Field of Search ..... 166/120, 122, 133, 134, 166/131, 332, 187, 189, 321

[56] References Cited

U.S. PATENT DOCUMENTS

| | | | |
|---|---|---|---|
| 2,902,093 | 9/1959 | Brown | 166/332 |
| 3,098,526 | 7/1963 | Heron | 166/133 |
| 3,239,008 | 3/1966 | Leutwyler | 166/189 |
| 3,252,516 | 5/1966 | Leutwyler | 166/189 |
| 3,364,997 | 1/1968 | Current | 166/134 |
| 3,381,752 | 5/1968 | Elliston | 166/120 |
| 3,414,058 | 12/1968 | Rochemont | 166/189 |
| 3,797,573 | 3/1974 | Crowe | 166/321 |
| 3,841,400 | 10/1974 | Callihan et al. | 166/189 |
| 4,143,712 | 3/1979 | James et al. | 166/133 |
| 4,271,903 | 6/1981 | Slagle, Jr. et al. | 166/129 |
| 4,503,913 | 3/1985 | Carmody | 166/332 |

*Primary Examiner*—Stephen J. Novosad
*Assistant Examiner*—Bruce M. Kisliuk
*Attorney, Agent, or Firm*—Sughrue, Mion, Zinn, Macpeak & Seas

[57] ABSTRACT

An annular safety assembly comprising, between an upper cylindrical body and a lower cylindrical body, through which connecting tubes of production tubes pass, a packer and a low-bulk anchorage system consisting of a radial spacing ring, a resilient anchorage ring split along a generatrix and provided with peripheral anchorage teeth and a thrust ring which can be moved upwardly by thruster-plungers extending from the lower cylindrical body to apply the anchorage ring to the casing, and a safety valve arranged separately from the connecting tubes, which extend between the said cylindrical bodies, and below the lower cylindrical body.

8 Claims, 16 Drawing Figures

ANNULAR SAFETY ASSEMBLY FOR AN OIL WELL, ESPECIALLY A DOUBLE PRODUCTION ZONE WELL

The invention relates to the annular safety assembly which it is often necessary to provide in an oil well, in addition to the conventional safety valves isolating the production tubes, when there is communication between a production tube and the annular space enclosed between the production tube and the annular space enclosed between the production tube and the casing, as is the case, for example, in secondary recovery methods such as gas-lift and entrainment by an ejector pump.

For this annular safety assembly, installed at a relatively small depth, use has been made hitherto of packer assemblies of the same type as the packer assemblies used to separate production zones at the bottom of the wells, by combining them with a fishable annular safety valve allowing or precluding communication between the annular spaces situated above and below the packer respectively.

However, the annular safety packer is subjected to considerably forces as a result of being located relatively high in the well, at a depth where the weight of the completion to be handled is very great. Even reinforced production packers are not well suited to such stresses.

Furthermore, when a double completion is involved, that is to say a completion containing two production tubes associated with two distinct production zones, difficulties in installing the annular safety assembly are encountered, owing to lack of space, especially when these tubes are large in diameter.

The annular safety valves used at the present time are either installed inside a production tube producing a restriction of the passage available for the fluid produced in the production zone associated with the production tube, and from which they can be fished only after stopping the production in the production tube, or installed in a side pocket carried by a production tube, communication between the annular spaces situated on either side of the packer relying in this case on a very tortuous passage resulting in high pressure drops.

According to the present invention, there is provided an annular safety assembly comprising a lower cylindrical body and an upper cylindrical body which are spaced apart by at least one connecting tube for providing the connection between two aligned sections of production tubing situated one on each side of the said assembly and from the top downwards between the two cylindrical bodies, a packer arranged transversely around said connecting tube and capable of being applied, by transverse extension resulting from a lengthwise compression, against a casing into which the production tube is to be introduced lengthwise, a radial spacing ring having a conical outer surface sloping inwards from top to bottom, a resilient anchorage ring split along a generatrix, provided with anchorage teeth at its outer periphery and having a conical inner surface with the same slope as the slope of the said conical outer surface of said spacing ring and applied at least partly thereagainst, and a thrust ring, and in said lower cylindrical body, a system of rams with upwardly projecting thruster-plungers and adapted to be activated by the introduction of a fluid under pressure into said rams for displacing said thrust ring upwards, said anchorage ring being adapted, in a first step, to be applied against the casing by an upward displacement thereof relative to said spacing ring under the action of said thrust ring, itself displaced by said thruster-plungers and, in a second step, while said anchorage ring is held lengthwise against the casing, to penetrate the casing transversely with said teeth under the effect of a descending displacement of said spacing ring relative to said anchorage ring permitting the lengthwise compression of said packer between said immobilized spacing ring and said upper cylindrical body, said spacing anchorage and thrust rings allowing a sufficient inner free space, and a safety valve allowing or precluding passage from one lengthwise side to the other lengthwise side of said packer, said safety valve being arranged separately from said connecting tube arranged inside the assembly consisting of and between said cylindrical bodies.

Preferably, the anchorage ring has, at its outer periphery, a series of lengthwise zones which project and are recessed alternately, only the projecting zones carrying the teeth.

Preferably, communication is established in the said lower cylindrical body between one of the connecting tubes, or the connecting tube when there is only one, and the system of rams to enable fluid under pressure to be introduced into the rams from the one or the production tube.

The assembly may also comprise a system of upward retention plungers extending from manoeuvring chambers in the upper cylindrial body and connected by lengthwise conduits to control chambers arranged in the lower cylindrical body and closed by floating plungers, the manoeuvring and control chambers and the lengthwise conduits being filled with hydraulic oil and the floating plungers being subjected externally to the pressure prevailing below the said lower cylindrical body.

For economy of space, the lengthwise conduits may pass inside the thruster-plungers, these latter sliding around the lengthwise conduits.

The safety valve is preferably a valve with a bottom flapgate arranged at the bottom of the lower cylindrical body and capable of being opened by a plunger tube, whose plunger has differential surfaces, is biased into an upper position by a return spring and is capable of being brought into a low position for opening the flapgate by establishing a pressure of hydraulic fluid in an annular chamber around the plunger tube including the plunger and surrounding the return spring, the annular chamber being delimited externally by a skirt extending from the lower cylindrical body to the upper cylindrical body, a conduit for supplying the annular chamber with hydraulic fluid being provided in the upper cylindrical body.

To improve the safety and to permit an optional equalization of the pressures on both sides of the flapgate before it opens, in an upper position, te upper end of the plunger tube may be applied against an annular seat, while at the beginning of its descending motion, this may uncover at least one side port for communication between the inside of the plunger tube and the space situated above the safety assembly.

To permit access to the space below the safety assembly even in the case where the conduit for supplying the annular chamber became defective, a communication passage may be provided between the space above the safety assembly and the inside of the annular seat, by means of a calibrated pressure valve which opens when there is excessive pressure in the space above the safety assembly.

An embodiment of a safety assembly according to the present invention, for a double completion, will now be described, by way of example only, with reference to the accompanying drawings.

Figure 1:
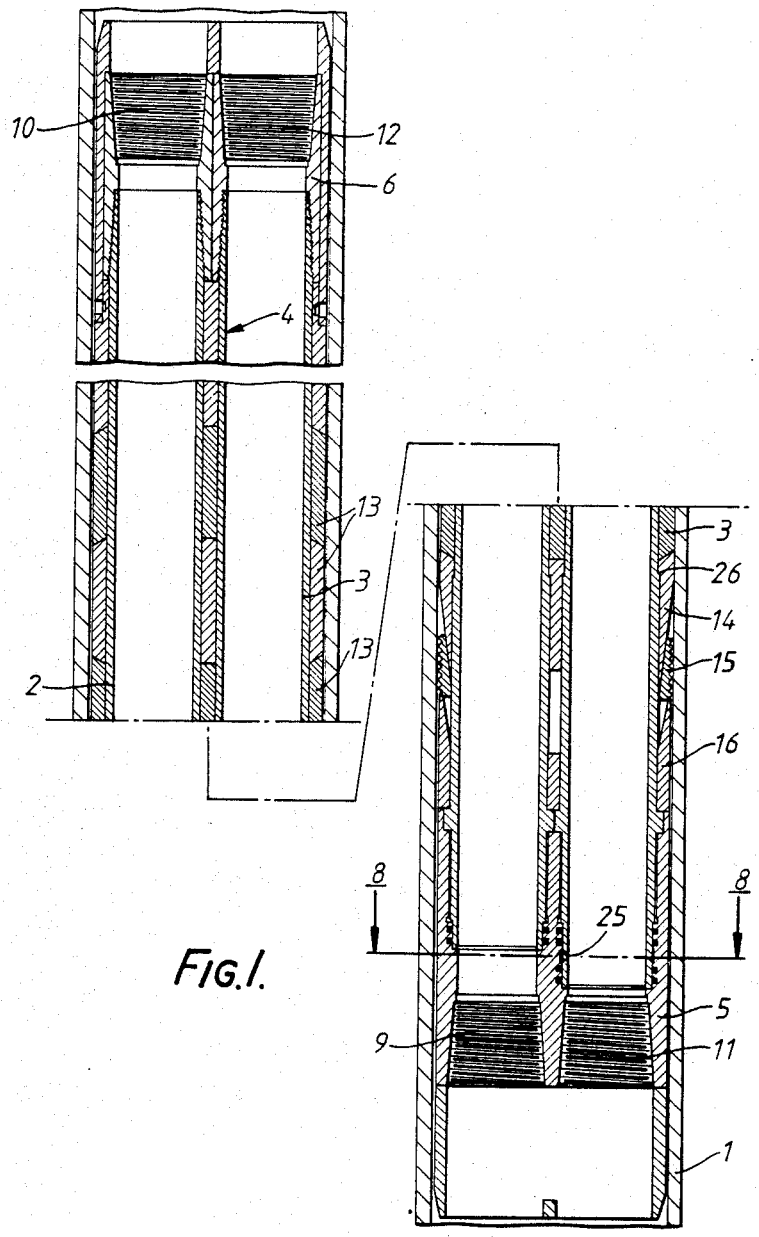
FIG. 1 is a first vertical section through an embodiment of a safety assembly according to the invention.
Figure 2:
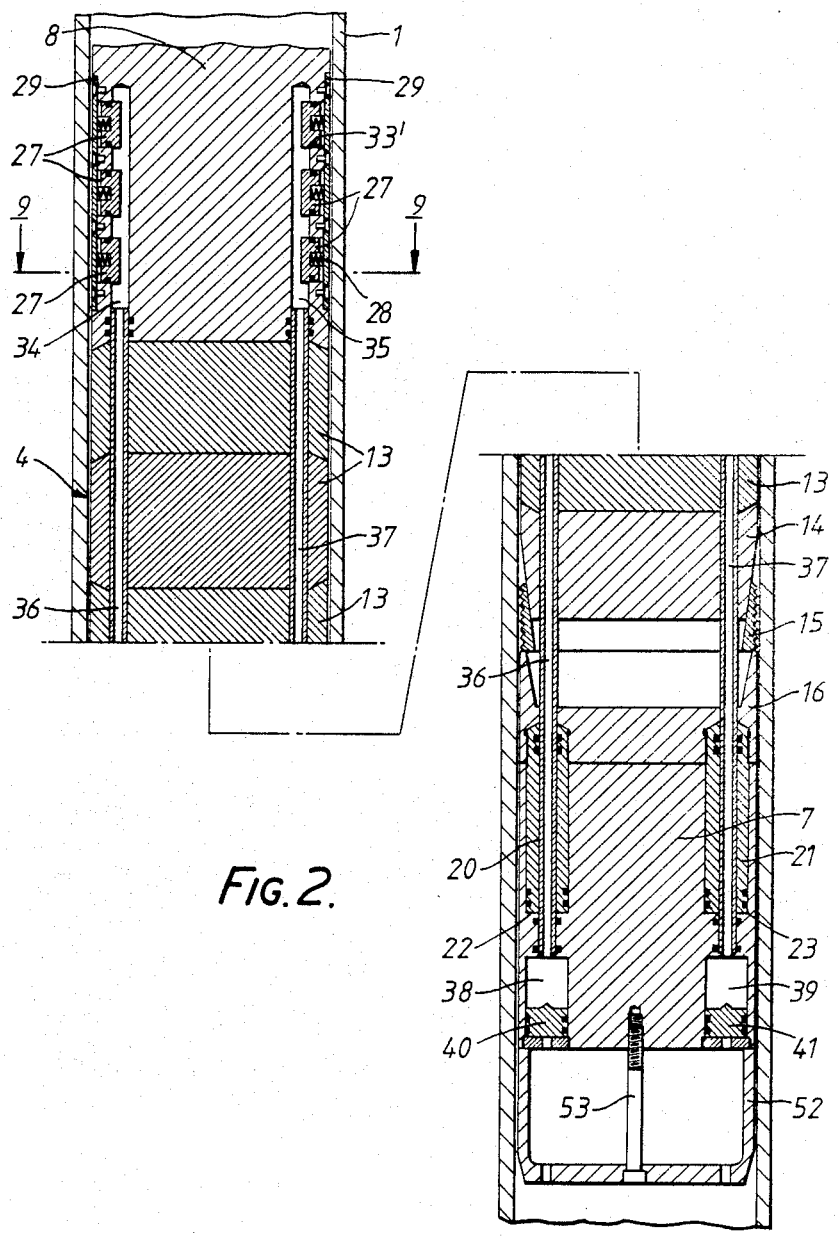
FIGS. 2, 3 and 4 are second vertical sections through the assembly of FIG. 1 showing three positions of the assembly being free, preanchored and anchored, respectively.
Figure 5:
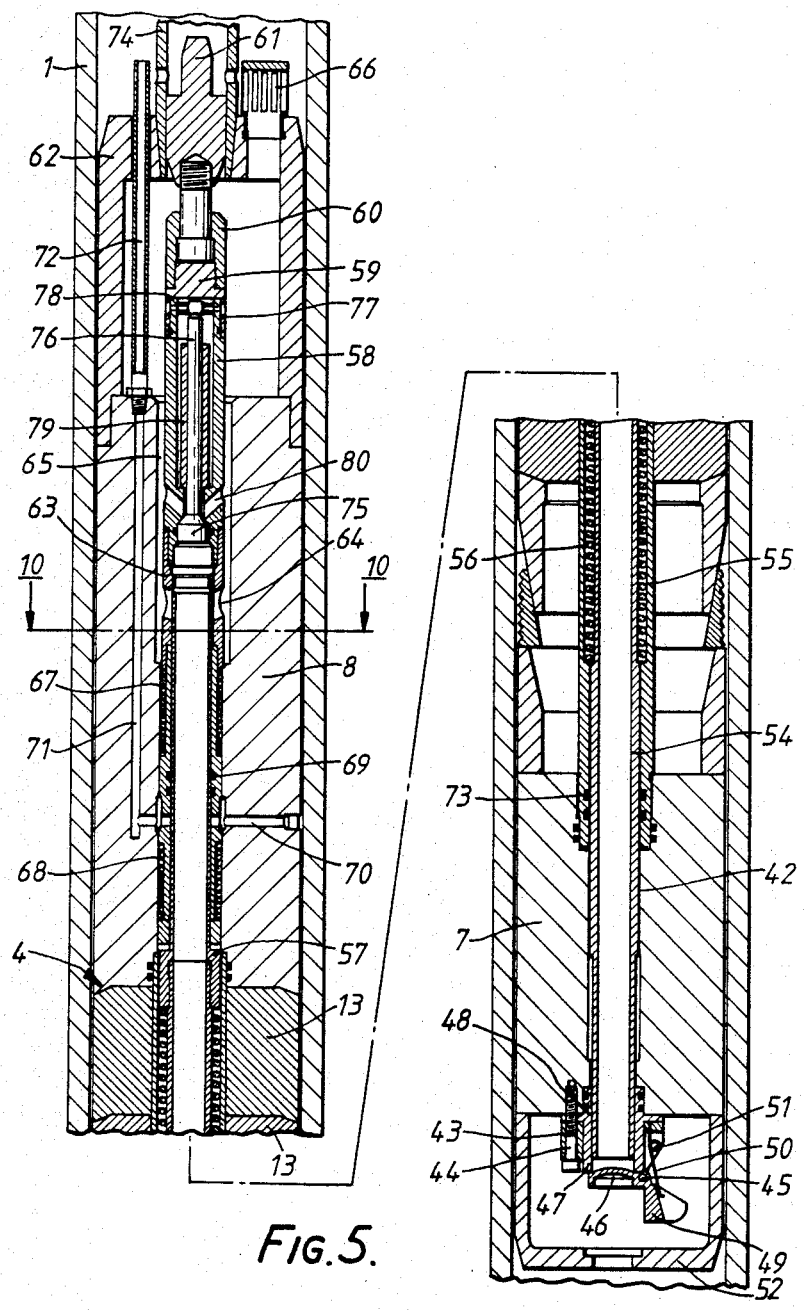
FIGS. 5, 6 and 7 are third vertical sections through the assembly of FIG. 1 for three positions of the assembly being valve closed, valve open, and forced injection, respectively.
Figure 8:
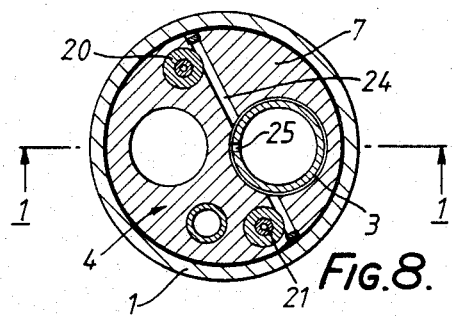
Figure 9:
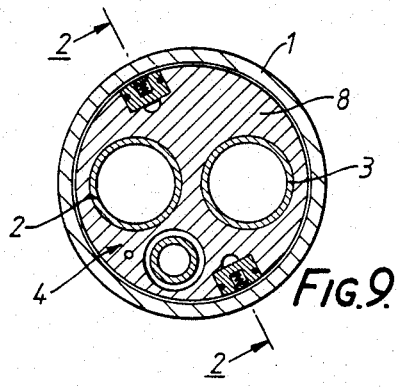
Figure 10:
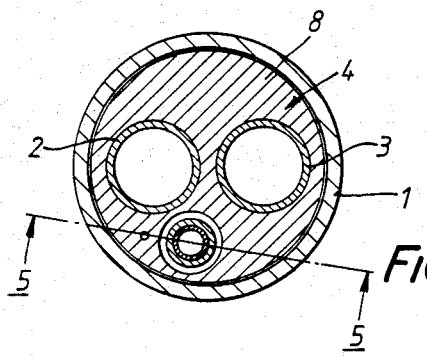

FIGS. 8, 9 and 10 are transverse sections through the safety assembly of FIG. 1 respectively, on the line 8—8 of FIG. 1, the line 9—9 in the FIG. 2 and the line 10—10 of FIG. 5, and show, respectively, by line 1—1 the position of the section shown in FIG. 1, by line 2—2 the portion of the section shown in FIG. 2 and by line 5—5 the portion of the section shown in FIG. 5.

Figure 11:
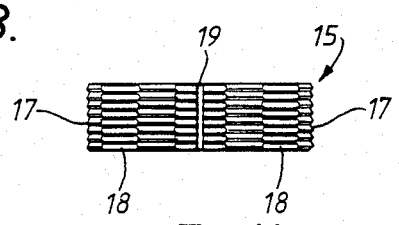
Figure 12:
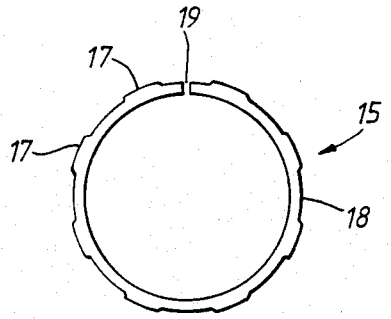
Figure 13:
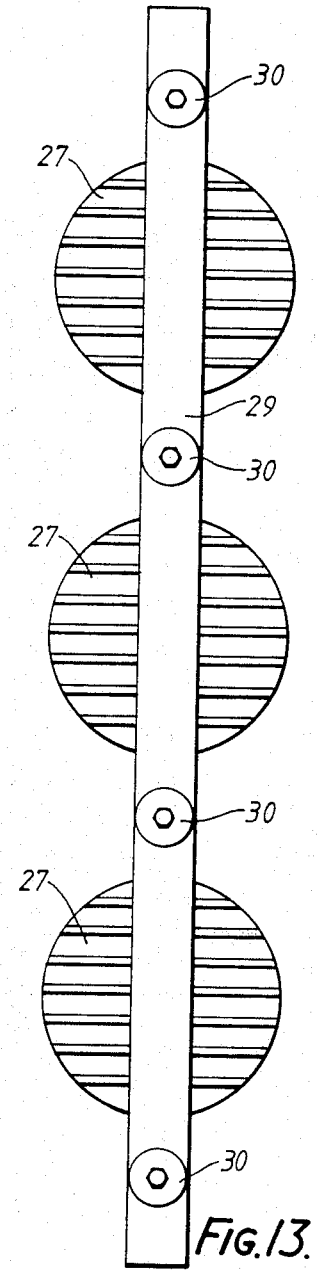

FIGS. 11 and 12 show an anchorage ring in elevation and from below respectively;

FIG. 13 shows a set of retaining plungers seen face on, and

Figure 14:
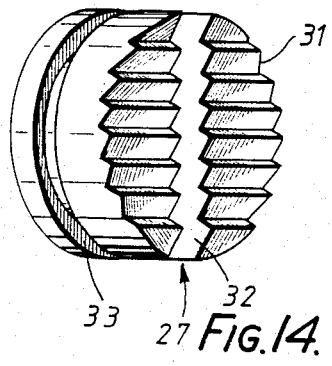
Figure 15:
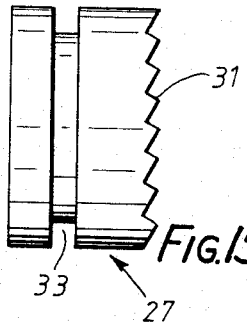
Figure 16:
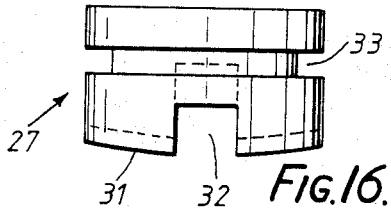

FIGS. 14, 15 and 16 show one of the retaining plungers of FIG. 13 in perspective, from one side and from above, respectively.

FIG. 1 shows a length of a casing 1 which is arranged in an oil well (not shown) and into which two production tubes (not shown) are introduced. Connecting tubes 2 and 3 forming the passages of the production tubes through an annular safety assembly 4 can be seen. These connecting tubes 2 and 3 are screwed at their lower part into a lower sleeve 5 and at their upper part into an upper sleeve 6. The lower sleeve 5 is integrally connected to a lower cylindrical body 7, which can be seen better in FIGS. 2, 5 and 8, and the upper sleeve 6 is integrally connected to an upper cylindrical body 8 which can be seen better in FIGS. 2, 5, 9 and 10. The first production tube comprises a lower part which is screwed into a coupling cone 9 arranged below the connecting tube 2 in the lower sleeve 5, and an upper part which is screwed into a coupling cone 10 arranged above the connecting tube 2 in the sleeve 6 (FIG. 1). The second production tube comprises a lower part which is screwed into a coupling cone 11 arranged below the connecting tube 3 in the lower sleeve 5, and an upper part which is screwed into a coupling cone 12 arranged above the connecting tube 3 in the upper sleeve 6.

As can be seen clearly in FIG. 2, between the upper cylindrical body 8 and the lower cylindrical body 7, there are, from the top downwards, a packer 13, a radial spacing ring 14, a resilient anchorage ring 15 split along a generatrix and a thrust ring 16. The radial spacing ring 14 is partly engaged, by means of its conical outer surface which slopes inwardly from the top to the bottom, in the conical inner surface of the anchorage ring 15 which has the same slope. This slope is preferably of the order of 7°. The anchorage ring 15 has externally a circumferential series of projecting lengthwise zones 17 and recessed lengthwise zones 18, as shown by FIGS. 11 and 12. The projecting lengthwise zones 17 are provided with anchorage teeth comprising milled teeth sloping at about 60°. The recessed lengthwise zones 18 form abutments and considerably reduce the distortion of the casing against which the ring 15 is clamped. FIGS. 11 and 12 also show the slit 19 along the generatrix of the anchorage ring. The ring 15 is made of a nickel, chromium and iron alloy such as that known as "Inconel" (Trade Mark), an alloy which has resilient properties, hardness properties and anticorrosive properties at the same time.

This anchorage system is compact and leaves a lot of free space in the annular safety assembly, permitting the installation of two connecting tubes 2 and 3 and possibly even a third connecting tube, as well as a safety valve.

The thrust ring 16 can be displaced upwards by two plungers 20, 21, which can be seen in FIGS. 2 and 8. These plungers 20 and 21 slide in a leakproof manner in cylinders 22 and 23 (FIG. 2) whose lower parts communicate with the connecting tube 3 by means of a hole 24 (FIG. 8) drilled in the lower cylindrical body 7 and an orifice 25 (FIGS. 1 and 8) arranged at the bottom of the connecting tube 3. Thus, the entry of a compressed fluid into the connecting tube 3 actuates the plungers 20 and 21 and displaces the thrust ring 16 upwards.

The function of the radial spacing ring 14 is not only to spread out the anchorage ring 15 radially, but also to serve as an anti-creep ring for retaining the elastomers forming the packer 13, by virtue of its upper dish-shaped profile. At least one shoulder 26, inside the ring 14, which cooperates with a corresponding shoulder on one of the connecting tubes 2, 3 enables the anchorage ring 15 to be released from anchorage by raising the connecting tubes 2, 3, that is to say by raising the production tubes.

As can be seen in FIG. 2, in the upper cylindrical body 8 there are provided the two rows of retaining plungers 27, for upward retention, normally held at a distance from the casing 1 by springs 28 bearing on rods 29 fixed to the body 8 by screws 30, which can be seen better in FIG. 13. The retaining plungers 27 have a toothed retaining face 31, as can be seen in FIGS. 14 and 15, which is interrupted in the centre of each plunger by a guiding slot 32 (FIGS. 14 and 16) in which rod 29 is received.

Each retaining plunger 27 is provided with a groove 33 (FIGS. 14 to 16) in which a ring seal 33', which can be seen in FIG. 2, is intalled, enabling the retaining plungers 27 to slide radially in a leakproof manner in the upper cylindrical body 8. The retaining plungers 27 of each of the two rows adjoin a manoeuvring chamber 34, 35, respectively, connected by a lengthwise, that is to say vertical, conduit 36, 37, respectively, to a control chamber 38, 39, respectively, arranged in the lower cylindrical body 7. The space formed by each manoeuvring chamber 34 or 35, the connected lengthwise conduit 36 or 37 and the connected control chamber 38 or 39 is filled with hydraulic oil. Each of the two control chambers 38, 39 is closed near its bottom by a floating plunger 40, 41 which is subjected externally to the pressure prevailing below the lower cylindrical body 7. On its upper face, the floating plunger 40, 41 has a valve pin capable of closing the bottom of the lengthwise conduit 36, 37 so as to isolate any possible leakage.

It will be noted that the lengthwise conduits 36, 37 run through a bore made in the thruster-plungers 20 and 21, in order to save space. Thus, the plungers 20 and 21 are in the form of hollow cylinders sliding in a leakproof manner internally in the cylinders 22, 23 arranged in the lower cylindrical body 7 and internally on the lengthwise conduits 36, 37.

In its lower part, the upper cylindrical body 8 forms a dish with a profile similar to that of the dish formed by the upper part of the radial spacing ring 14, so that the weight of the completion can be applied to the packer 13, made of elastomers, without the latter creeping along the casing.

As can be seen in FIG. 5, a vertical passage 42, which can be closed both in its upper part and in its lower part is provided through the safety assembly 4. At the bottom of the lower cylindrical body 7 a flapgate-carrier 43 is provided, held by at least one fitting screw 44 on which is articulated, around a flapgate pivot 45, a flapgate 46 which is applied against a lip seal 47 mounted on a seal-carrier 48 carried by the flapgate-carrier 43, so as to close the passage 42, under the combined action of a counterweight 49 and a return spring 50 mounted on a pivot 51. The counterweighted flapgate is protected by a lower protective housing 52 held in place by a set of three screws, which has been shown in a simplified fasion by a single screw 53 in FIG. 2.

The flapgate 46 can be opened by a plunger tube 54 sliding in the vertical passage 42. Around this plunger tube 54 is arranged a skirt 55 extending from the upper cylindrical body 8 to the lower cylindrical body 7 and containing a return spring 56 for the plunger tube. The lower part of the return spring 56 bears on a lower part of the skirt 55 and the top part presses a plunger 57 which is integrally fixed to the plunger tube 54 upwards.

Introduced into the top part of the vertical passage 42, situated in the upper cylindrical body 8, there is an auxiliary body 58 closed at its upper end by a hood 59 suspended by means of a rotary coupling 60 from a suspension coupling 61 screwed by a left-handed thread into an upper housing 62 mounted on top of the upper cylindrical body 8.

The auxiliary body 58 comprises an annular seat 63 made, for example, of polytetrafluoroethylene, against which the top end of the plunger tube 54 is applied when the plunger tube 54 is in an upper position. Below this seat 63, the body 58 has side ports 64 which permit communication between the inside of the plunger tube 54 and the space above the upper housing 62 as soon as the plunger tube 54 has left its upper position and has separated from the seat 63; this communication takes place through an annular space 65 between the body 58 and the vertical passage 42 opposite the port 64, through the inner space of the upper housing 62 and through a strainer 66 mounted on the upper housing 62.

Figure 6:
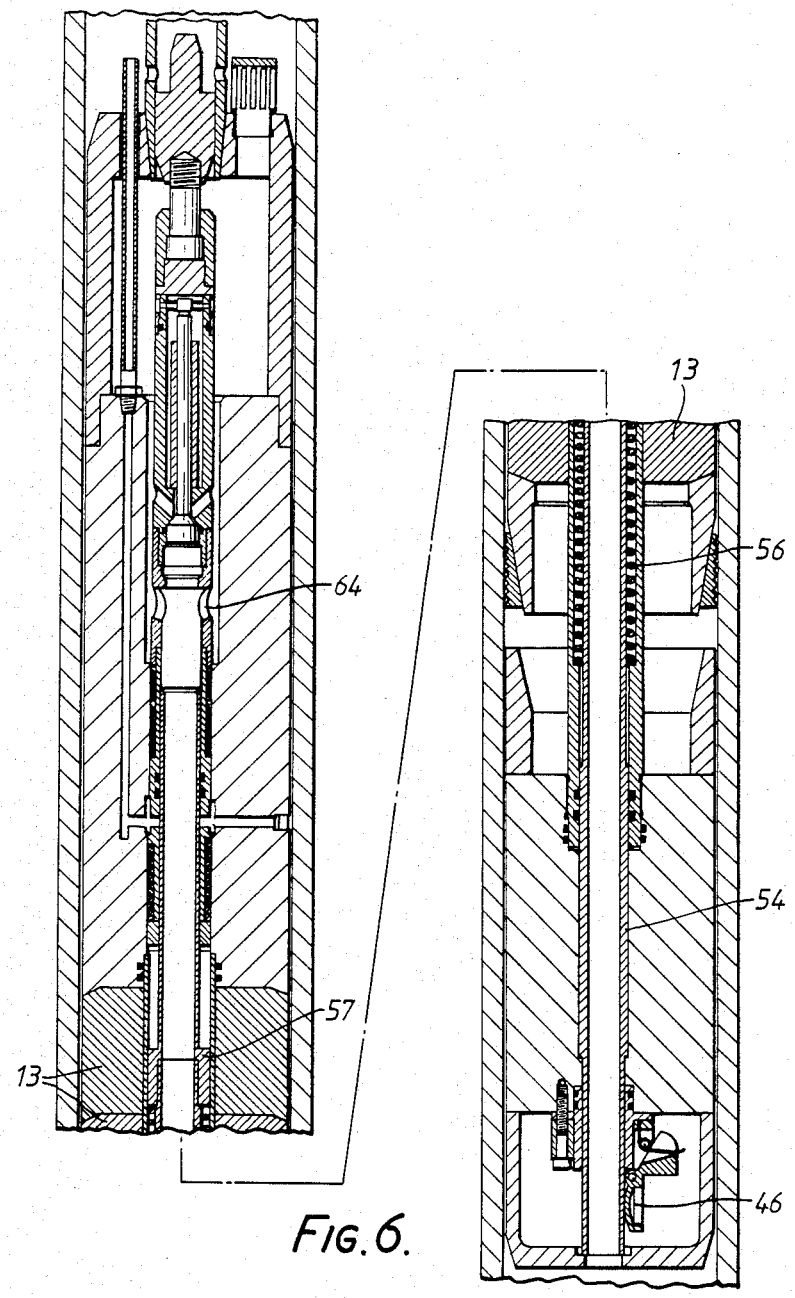

A downward extension of the body 58 externally carries two chevron seals, an upper seal 67 and a lower seal 68, between the levels of which there are, from top to bottom, at least one internal ring seal 69 which is applied against the plunger tube 54 and at least one transverse passage 70. A conduit 71 for delivering hydraulic oil, which starts at the top of the upper cylindrical body 8, where it is connected to an oil delivery tube 72, opens from the said cylindrical body 8 into the vertical passage 42 at the level of the transverse passage 70. Thus, hydraulic oil delivered by the tube 72 fills the space included under the seal 69 between the plunger tube 54 and the skirt 55, the latter being provided at its lower end with at least one seal 73 which is applied against the plunger tube 54. The plunger 57 has differential surfaces such that the presence of oil under pressure in the space just defined exerts a differential force on the plunger 57 driving the latter downwards against the action of the return spring 56 (FIG. 6).

The suspension coupling 61 is not screwed directly into the upper housing 62, but into a perforated tube 74 providing access to the safety assembly, the perforated tube being itself screwed into the upper housing 62.

An additional safety means is provided for use in the event of rupture of the hydraulic control line comprising the hydraulic oil delivery tube 72, in order to make access to the space situated below the annular safety assembly possible.

For this purpose, a forced injection valve 75 is fitted in the auxiliary body 58 above the seat 63 and plugs the body 58 so long as the valve is held in an upper position by a rod 76 held by shear pins 77 extending between the auxiliary body 58 and a retaining ring 78 fixed integrally to the rod 76. A travel limiter 79 stops the retaining ring 78 in the event of the shear pins 77 failing, after a short downward travel of the ring and, consequently, of the valve 75.

Figure 7:
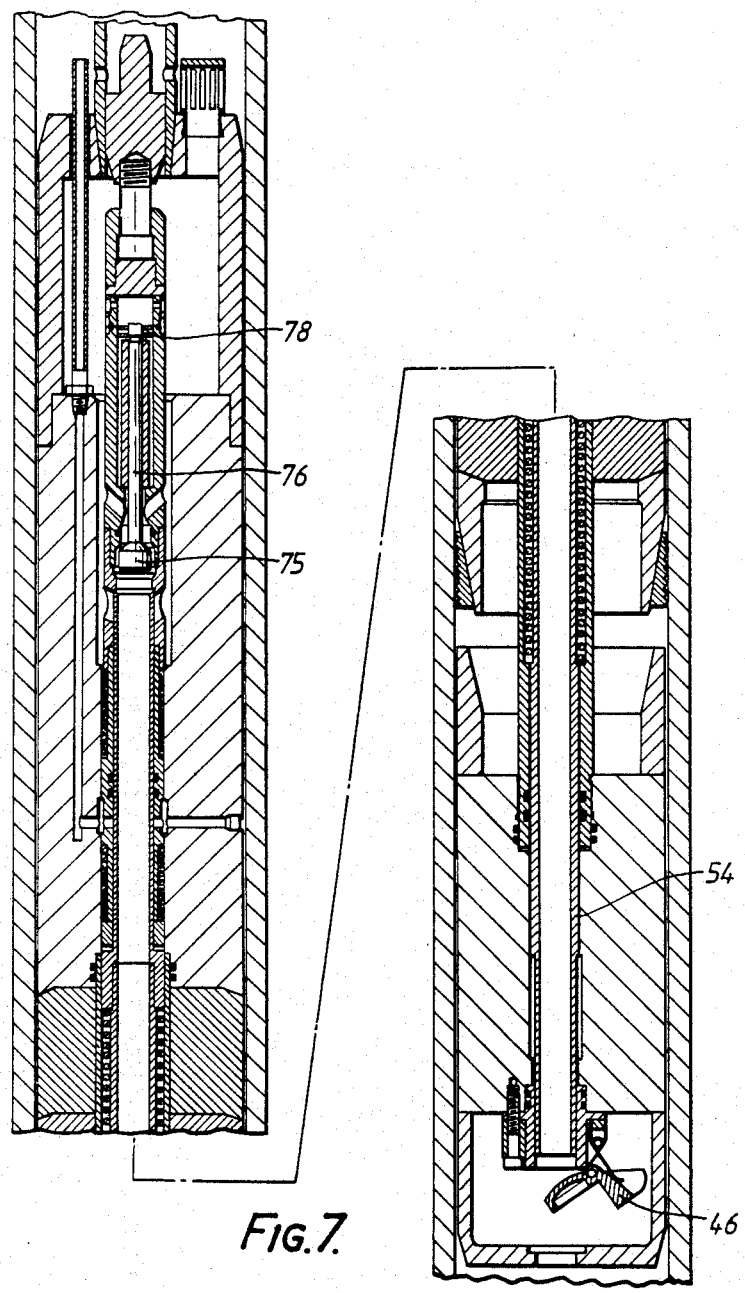

The pressure which prevails above the safety assembly is applied above the valve 75 through ports 80 arranged laterally in the auxiliary body 58. It is enough, therefore, to establish a sufficient overpressure above the safety assembly 4 to cause the failure of the pins 77 and the opening of the valve 75 to gain access of the space situated below the safety assembly 4 (FIG. 7).

The annular safety assembly operates as follows. To make it possible to lower the annular safety assembly in a casing 1 without risk of swabbing, the valve 46 is opened by pressurizing the hydraulic control line comprising the delivery tube 72. When the production tubes are screwed above the annular safety assembly 4, the perforated tube 74 can be extended concurrently in order to facilitate a possible withdrawal of the main parts of the annular safety assembly.

Figure 3:
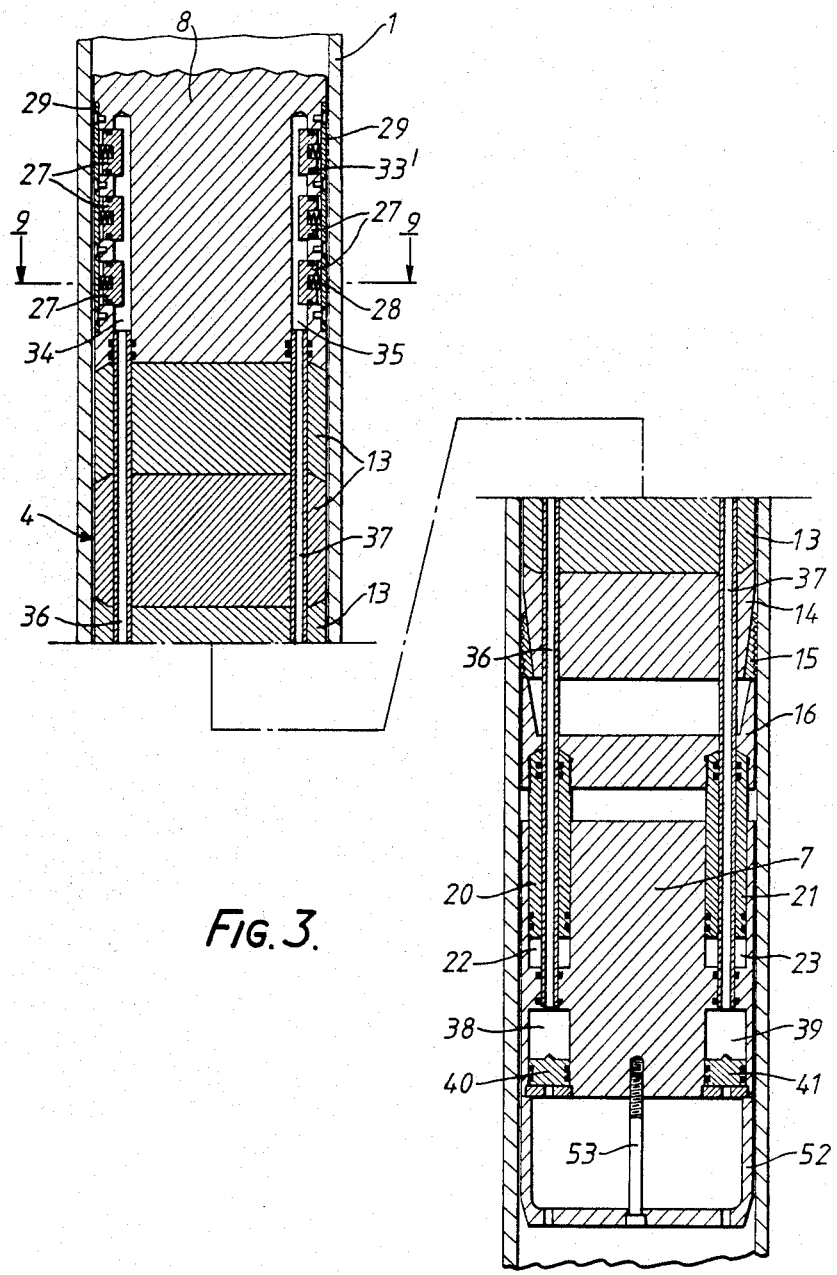
Figure 4:
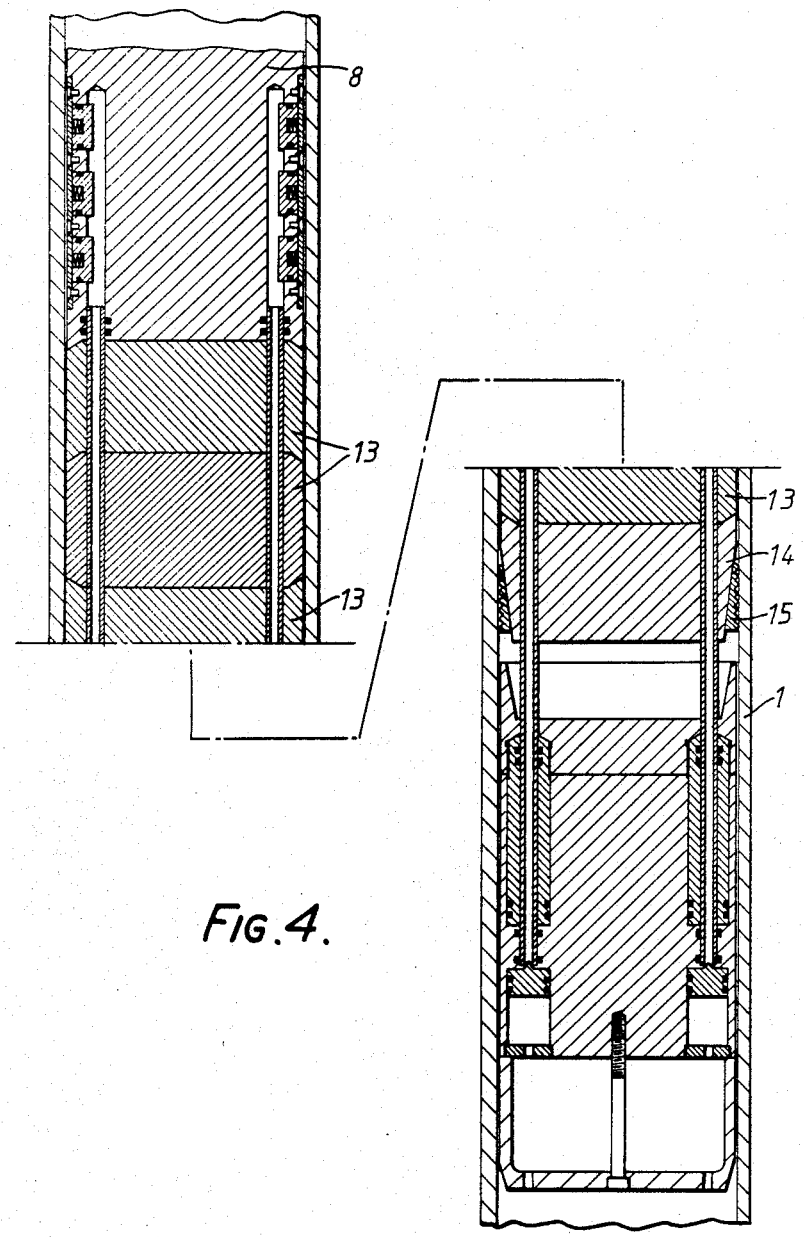

When the completion has been placed in position, while the conventional hangers, not shown here, for supporting the completion are in place in their housing, the weight of the completion is taken up to release the hangers and to lift them a few centimetres corresponding to the travel required for the transverse expansion of the elastomers of the packer 13 resulting from its lengthwise compression. Pressure is then applied to the production tube connected to the connecting tube 3 to move the anchorage ring 15 upwards and to bring it into contact with the casing 1 (FIG. 3). A low pressure is required for this movement. It is then possible to set down the weight of the completion, which is initially taken up on the upper cylindrical body 8, the packer 13 and the spacing ring 14 which clamps the anchorage ring 15 in the casing 1 (FIG. 4). The teeth 17 of the ring 15 transversely penetrating the casing. As the weight continues to be set down, the packer 13 is compressed lengthwise and expands transversely until it is in perfect contact with the casing 1 and provides the sealing.

The leaktightness of the packer 13 and of the annular safety assembly is checked by pressurizing the upper annular space (above the annular safety assembly 4,) after the plunger tube 54 has been raised. Obviously, the pressure required to shear the pins 77 must not be attained, as this would bring into action the forced injection valve 75 and would remove the sealing in the downstream direction, while allowing the sealing in the upstream direction to remain.

In normal operation, the upper annular space is at a pressure which is equal to or slightly greater than the pressure prevailing in the lower annular space below the annular safety assembly 4. In the event of an incident, conventional pressure detectors trigger off a hydraulic purge of the delivery tube 72: the valve 46 closes and the plunger tube 54 is applied against the seat 63, isolating the ports 64. Two safety barriers in series are thus available.

In the event of an incident resulting in the pressure in the lower annular space becoming higher than that in the upper annular space, the retaining plungers 27 are anchored in the casing 1 and prevent any upward movement of the completion, even in the highly improbable event of a simultaneous rupture of both production tubes.

To open the valve 46, the delivery tube 72 is pressurized to bring the plunger tube 54 into abutment with the valve 46. The upper annular space is then pumped up to increase the pressure in it and in the plunger tube 54 which communicates with this annular space via the ports 64 which are partly open, which balances the pressures on both sides of the valve 46 and allows it to open (FIG. 6).

To release the anchorage, which can be performed only after the retaining plungers 27, if appropriate, have been retracted, a recovery of the weight of completion decompresses, in a first step, the elastomers of the packer 13 and, in a second step, causes the spacing ring 14 to be entrained by the connecting tubes 2 and 3 supported by the shoulder 26, thus releasing the anchorage ring 15. As a result of its resiliency and of the suitable profile of its teeth, the latter returns to its rest position. The annular safety assembly 4 is thus made free to travel up or down; it can be raised with the completion or, indeed, be anchored again at a different depth.

There is thus provided an annular safety assembly adapted to withstand high stresses, with a low-bulk anchorage system which can be manoeuvred several times without being raised back to the surface and a permanent safety valve with a wise-diameter passage and of short length.

What is claimed is:

1. An annular safety assembly comprising a lower cylindrical body (7) and an upper cylindrical body (8) which are spaced apart and permanently held in a fixed position relative to each other by at least one connecting tube (2,3) for providing a connection between two aligned sections of production tubing situated one or each side of the said assembly and, from the top downwards between the two cylindrical bodies, a packer (13) arranged transversely around said connecting tube and capable of being applied, by transverse extension resulting from a lengthwise compression, against a casing into which the production tube is to be introduced lengthwise, a radial spacing ring (14) having a conical outer surface sloping inwards from top to bottom, a resilient anchorage ring (15) split along a generatrix, provided with anchorage teeth at its outer periphery and having a conical inner surface with the same slope as the slope of the conical outer surface of said spacing ring and applied at least partly thereagainst, and a thrust ring (16), and in said lower cylindrical body, a system of rams with upwardly projecting thruster-plungers (20,21) and adapted to be activated by the introduction of a fluid under pressure into said rams for displacing said thrust ring upwards, said anchorage ring being adapted, in a first step, to be applied against the casing by an upward displacement thereof relative to said spacing ring under the action of said thrust ring, itself displaced by said thruster-plungers and, in a second step, while said anchorage ring is held lengthwise against the casing to penetrate the casing transversely with said teeth under effect of a descending displacement of said spacing ring relative to said anchorage ring caused by the application of the weight of said assembly and said aligned sections of production tubing and permitting other lengthwise compression of said packer between said immobilized spacing ring and said upper cylindrical body, said anchorage ring and thrust ring forming a compact anchorage system and a channel (42) disposed parallel to and separate from said at least one connecting tube and extending through said lower cylindrical body (7) and said upper cylindrical body (8) and a safety valve secured to the lower end of said lower cylindrical body in alignment with said passage, said safety valve allowing to precluding passage of fluid through said passage from one lengthwise side to the other lengthwise side of said packer.

2. An annular safety assembly according to claim 1, wherein said anchorage ring has, at its outer periphery, a series of lengthwise zones which are projecting (17) and recessed (18) alternately, only said projecting zones carrying said teeth.

3. An annular safety assembly according to claim 1, wherein communication means (24,25) is provided in said lower cylindrical body between said connecting tube and said system of rams for permitting fluid under pressure to be introduced into said rams from said production tube.

4. An annular safety assembly according to claim 1, comprising a system of plungers for upward retention extending from manoeuvring chambers (34,35) arranged in said upper cylindrical body and connected by lengthwise conduits (36,37) to control chambers (38,39) arranged in said lower cylindrical body and closed by floating plungers (40,41), said manoeuvring chambers, control chambers and lengthwise conduits being filled with hydraulic fluid and said floating plungers being subject externally to the pressure prevailing below said lower cylindrical body.

5. An annular safety assembly according to claim 4, wherein said lengthwise conduits (36,37) extend inside said thruster-plungers (20,21) which are slidable around said lengthwise conduits.

6. An annular safety assembly according to claim 1, wherein said safety valve comprises a flapgate safety valve (46) openable by a plunger tube (54) having a plunger with differential surfaces, biased into an upper position by a return spring (56) and capable of being brought into a lower position for opening said flapgate by establishing a pressure of hydraulic fluid in an annular chamber (65), extending around said plunger tube including said plunger and surrounding said return spring, said flapgate being arranged at the bottom of said lower cylindrical body, said annular chamber being substantially delimited externally by a skirt (55) which extends from said lower cylindrical body to said upper cylindrical body, a conduit (71) for supplying hydraulic oil to the said annular chamber being provided in said upper cylindrical body.

7. An annular safety assembly according to claim 6, wherein in an upper position, an uppermost end of said plunger tube is applied against an annular seat (63) and it uncovers, at the beginning of the descending motion of said plunger tube, at least one side port (64) for communication between an interior surface of said plunger tube and the space above said annular safety assembly.

8. An annular safety assembly according to claim 7, wherein above said annular seat there is provided a passage for communication between the space above said safety assembly and the inside of said annular seat, normally closed by a calibrated pressure valve which opens when there is excess pressure in the space above said safety assembly.

* * * * *